US010823013B2

(12) United States Patent
Waslo

(10) Patent No.: US 10,823,013 B2
(45) Date of Patent: Nov. 3, 2020

(54) DUAL TIEROD ASSEMBLY FOR A GAS TURBINE ENGINE AND METHOD OF ASSEMBLY THEREOF

(71) Applicant: GENERAL ELECTRIC COMPANY, Schenectady, NY (US)

(72) Inventor: Daniel Waslo, Lynn, MA (US)

(73) Assignee: General Electric Company, Schenectady, NY (US)

( * ) Notice: Subject to any disclaimer, the term of this patent is extended or adjusted under 35 U.S.C. 154(b) by 607 days.

(21) Appl. No.: 15/282,547

(22) Filed: Sep. 30, 2016

(65) Prior Publication Data

US 2018/0094544 A1 Apr. 5, 2018

(51) Int. Cl.
*F01D 25/28* (2006.01)
*F01D 5/06* (2006.01)

(52) U.S. Cl.
CPC ..... *F01D 25/28* (2013.01); *F01D 5/066* (2013.01); *F05D 2230/60* (2013.01); *F05D 2250/311* (2013.01); *F05D 2250/312* (2013.01); *F05D 2260/31* (2013.01)

(58) Field of Classification Search
CPC ..... F01D 5/066; F01D 13/006; F01D 25/28; F02C 3/10; F02C 3/107; F02C 3/145; F02C 7/20; F02C 7/36; F05D 2230/60; F05D 2260/31
See application file for complete search history.

(56) References Cited

U.S. PATENT DOCUMENTS 2,779,531 A 1/1957 Wheatley
3,842,595 A * 10/1974 Smith ..... F02C 7/20 60/804
5,288,210 A * 2/1994 Albrecht ..... F01D 5/066 416/198 A
5,537,814 A * 7/1996 Nastuk ..... F01D 5/066 60/796
8,545,171 B2 10/2013 Benkler et al.
8,579,538 B2 * 11/2013 Juh ..... F01D 5/066 403/359.5
8,650,885 B2 * 2/2014 Reinhardt ..... F01D 5/066 415/216.1
8,727,718 B2 5/2014 Aschenbruck et al.
8,794,923 B2 8/2014 Tirone, III et al.
(Continued)

FOREIGN PATENT DOCUMENTS

CN 102359396 A 2/2012
CN 104420887 B 6/2016
EP 2589748 A2 5/2013

OTHER PUBLICATIONS

Chinese Office Action Corresponding to CN Application 2017109037679 dated Mar. 5, 2019.
(Continued)

*Primary Examiner* — Brian P Wolcott
(74) *Attorney, Agent, or Firm* — Dority & Manning, P.A.

(57) ABSTRACT

A core engine includes a first tierod and a compressor rotor assembly including a plurality of compressor rotor disks arranged in a face to face orientation and spaced along the first tierod. The core engine includes a second tierod and a turbine rotor assembly including a plurality of turbine rotor disks arranged in a face to face orientation and spaced along the second tierod. The compressor rotor assembly is aft of the turbine rotor assembly.

20 Claims, 3 Drawing Sheets

(56) References Cited

U.S. PATENT DOCUMENTS

| | | | | |
|---|---|---|---|---|
| 8,875,378 | B2 | 11/2014 | Coffin | |
| 9,121,280 | B2 * | 9/2015 | Benjamin | F01D 5/066 |
| 10,094,279 | B2 * | 10/2018 | Kupratis | F02K 3/06 |
| 2007/0012047 | A1 * | 1/2007 | Sasu | B23K 20/12 60/791 |
| 2015/0322961 | A1 | 11/2015 | Slotman | |
| 2015/0345503 | A1 | 12/2015 | Del Vescovo et al. | |
| 2015/0369131 | A1 | 12/2015 | Wong et al. | |
| 2016/0032780 | A1 | 2/2016 | Grogg et al. | |
| 2016/0146101 | A1 | 5/2016 | Lee | |
| 2016/0258292 | A1 * | 9/2016 | Kondo | F01D 5/066 |
| 2017/0320584 | A1 * | 11/2017 | Menheere | B64D 27/10 |
| 2018/0023482 | A1 * | 1/2018 | Lefebvre | F02C 3/113 415/68 |

OTHER PUBLICATIONS

Translated Chinese Office Action Corresponding to Application No. 201720903767 dated Sep. 26, 2019.

Liu et al, "Bearing-rotor Dynamic Research on MS6001B Gas Turbine-Generator Set", CNKI Master's Theses Full-text Database, Shao-quan, Dec. 30, 2011, pp. 1-15.

* cited by examiner

DUAL TIEROD ASSEMBLY FOR A GAS TURBINE ENGINE AND METHOD OF ASSEMBLY THEREOF

BACKGROUND

The field of the disclosure relates generally to gas turbine engines and, more particularly, to a dual tierod assembly for use in gas turbine engines and method of assembly thereof.

At least some known gas turbine engines, such as a turboprop engine, include a core engine, and a power or low pressure turbine. The core engine includes at least one compressor, a combustor, and a high pressure turbine coupled together in a serial flow relationship. More specifically, the compressor and high-pressure turbine are coupled through a first drive shaft to form a high pressure rotor assembly. Air entering the core engine is compressed then mixed with fuel and ignited to form a high temperature and high energy gas stream. The high energy gas stream flows through the high pressure turbine to rotatably drive the high pressure turbine such that the shaft rotatably drives the compressor. The gas stream expands as it flows through the low pressure turbine positioned aft of the high pressure turbine. The low pressure turbine includes a rotor assembly having a gearbox coupled to a second drive shaft. The low pressure turbine rotatably drives the gearbox through the second drive shaft.

In at least some known turboprops, the high pressure rotor assembly includes a plurality of compressor rotor disks and turbine rotor disks that are coupled together through a single central tierod restricting axial movement therein. During engine operation, however, turbine rotor disks operate at higher temperatures than compressor rotor disks, inducing a high temperature gradient difference in the tierod. Additionally, coupling the compressor rotor disks and turbine rotor disks together increases maintenance time and costs as the entire high pressure rotor assembly is tied together by a single tierod.

BRIEF DESCRIPTION

In one embodiment, a core engine is provided. The core engine includes a first tierod and a compressor rotor assembly including a plurality of compressor rotor disks arranged in a face to face orientation and spaced along the first tierod. The core engine includes a second tierod and a turbine rotor assembly including a plurality of turbine rotor disks arranged in a face to face orientation and spaced along the second tierod. The compressor rotor assembly is aft of the turbine rotor assembly.

In another embodiment, a gas turbine engine is provided. The gas turbine engine includes a low pressure turbine and a core engine coupled in flow communication with the low pressure turbine and positioned aft of the low pressure turbine. The core engine includes a first tierod and a compressor rotor assembly including a plurality of compressor rotor disks arranged in a face to face orientation and spaced along the first tierod. The core engine includes a second tierod and a turbine rotor assembly including a plurality of turbine rotor disks arranged in a face to face orientation and spaced along the second tierod. The compressor rotor assembly is aft of the turbine rotor assembly.

In a further embodiment, a method of assembling a core engine is provided. The method includes coupling a first tierod to a compressor rotor assembly, the compressor rotor assembly includes a plurality of compressor rotor disks arranged in a face to face orientation and spaced along the first tierod. The method further includes coupling a second tierod to a turbine rotor assembly, the turbine rotor assembly includes a plurality of turbine rotor disks arranged in a face to face orientation and spaced along the second tierod. The method also includes positioning the compressor rotor assembly aft of the turbine rotor assembly.

DRAWINGS

These and other features, aspects, and advantages of the present disclosure will become better understood when the following detailed description is read with reference to the accompanying drawings in which like characters represent like parts throughout the drawings, wherein.

Figure 1:
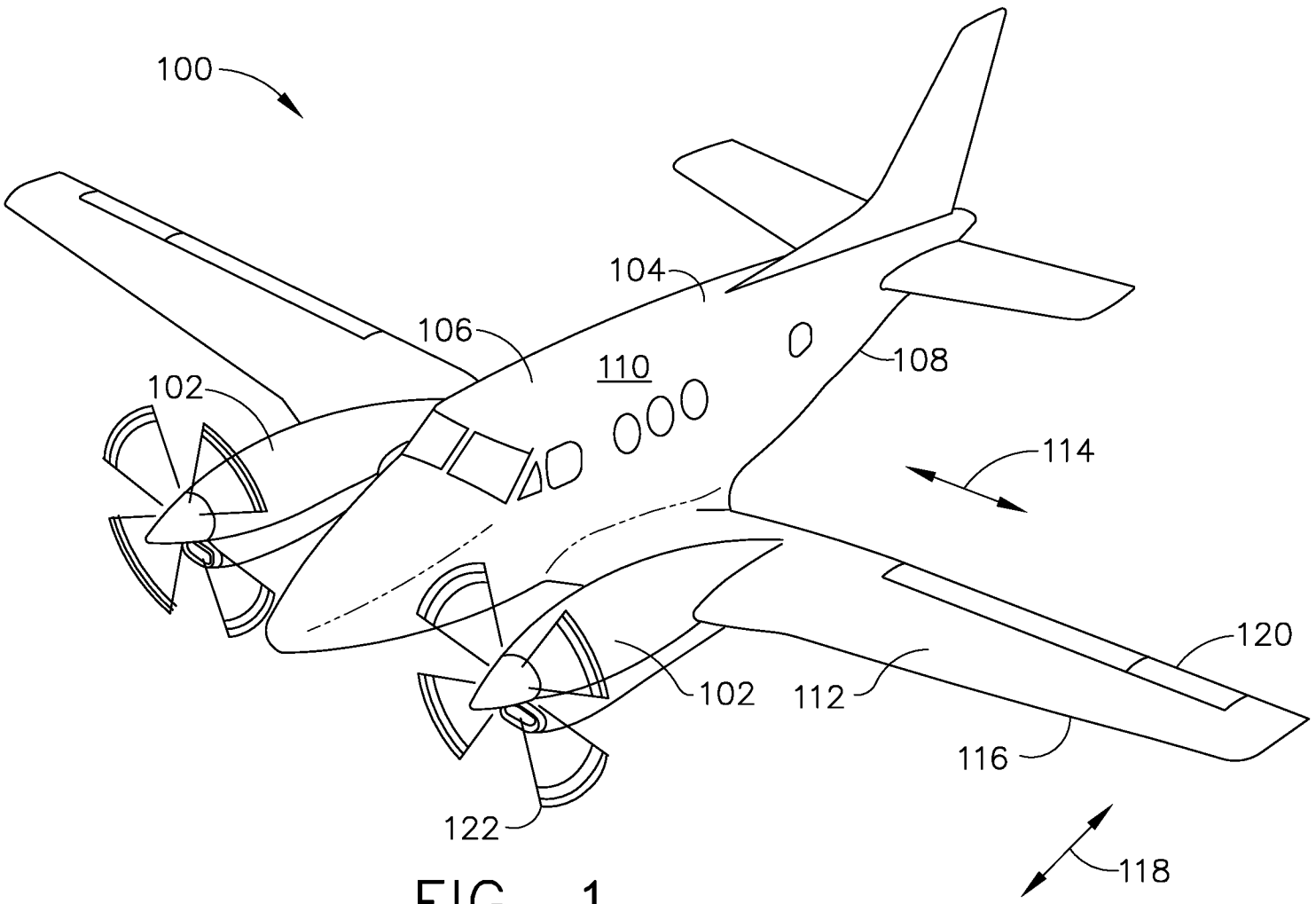
FIG. 1 is a perspective view of an aircraft including a turboprop engine in accordance with an example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of an engine. Moreover, the terms "radial" and "radially" refer to directions and orientations that extend substantially perpendicular to the centerline of the engine. In addition, as used herein, the terms "circumferential" and "circumferentially" refer to directions and orientations that extend arcuately about the centerline of the engine.

Embodiments of a tierod assembly for a turboprop engine as described herein provide a high pressure rotor assembly system that facilitates separating a high pressure compressor rotor assembly and a high pressure turbine rotor assembly. Specifically, the tierod assembly includes a compressor tierod that couples together the high pressure compressor rotor assembly, and a turbine tierod that couples together the high pressure turbine rotor assembly. By splitting a high pressure tierod into two separate tierods, the compressor tierod and the turbine tierod, increased management of thermal loads within the high pressure rotor assemblies is provided. Additionally, a separate compressor tierod and turbine tierod facilitates a modulated core engine in which the high pressure turbine rotor assembly may be removed for maintenance without disturbing the high pressure compressor rotor assembly. Furthermore, overall engine weight is reduced.

FIG. 1 is a perspective view of an aircraft 100 including an engine 102 in accordance with an exemplary embodiment of the present disclosure. In the exemplary embodiment, aircraft 100 includes a fuselage 104 that includes a nose 106, a tail 108, and a hollow, elongated body 110 extending therebetween. Aircraft 100 also includes a wing 112 extending away from fuselage 104 in a lateral direction 114. Wing 112 includes a forward leading edge 116 in a direction 118 of motion of aircraft 100 during normal flight and an aft trailing edge 120 on an opposing edge of wing 112. Aircraft 100 further includes at least one engine 102 that facilitates driving a bladed rotatable member 122 or fan to generate thrust. Engine 102 is coupled to at least one of wing 112 and fuselage 104, for example, in a pusher configuration proximate tail 108 (not shown). Although shown as a turboprop engine in FIG. 1, engine 102 may be embodied in a military purpose engine, a turbofan engine, a turboshaft engine, and/or any other type of engine.

Figure 2:
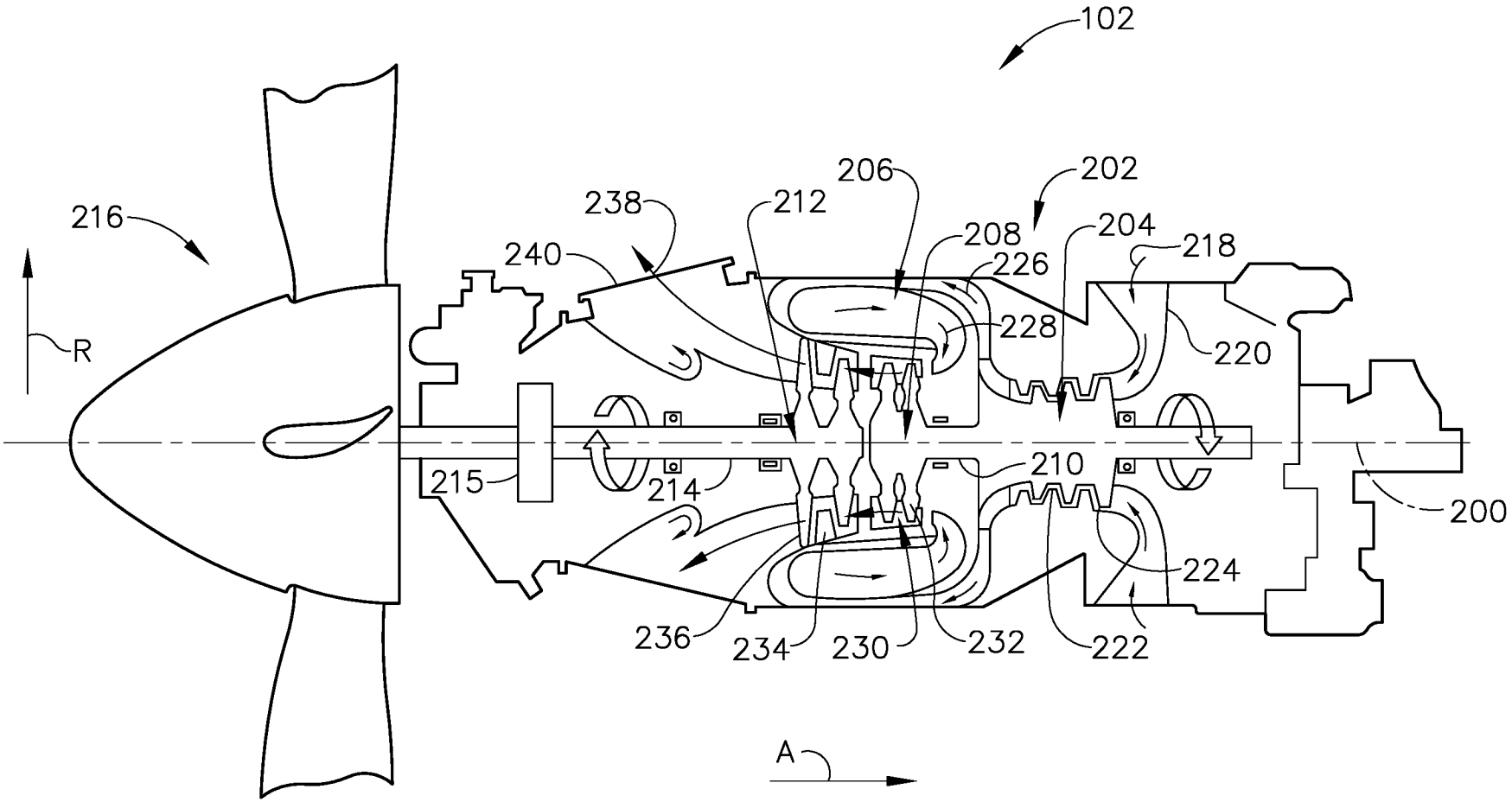
FIG. 2 is a schematic illustration of an exemplary turboprop engine as shown in FIG. 1.

FIG. 2 is a schematic illustration of engine 102 embodied as a turboprop engine in accordance with one exemplary embodiment of the present disclosure. In the exemplary embodiment, engine 102 is a reverse flow gas turboprop engine. While the example embodiment illustrates a reverse flow gas turboprop engine, the present disclosure is not limited to such an engine, and one of ordinary skill in the art will appreciate that the present disclosure may be used in connection with other turbine engines, such as, but not limited to, conventional axial flow turbine engines. As shown in FIG. 2, engine 102 defines an axial direction A, extending parallel to a longitudinal axis of rotation 200, and a radial direction R, extending perpendicular to longitudinal axis 200.

In the exemplary embodiment, engine 102 includes a core engine 202. Core engine 202 includes, in serial flow relationship, a high pressure (HP) compressor 204, an annular combustion section 206, and a high pressure (HP) turbine 208. A high pressure (HP) shaft or spool 210 drivingly connects HP turbine section 208 to HP compressor 204. Engine 102 further includes a power or low pressure (LP) turbine 212 in flow communication with core engine 202. In the exemplary embodiment, core engine 202 is positioned aft or upstream of LP turbine 212. A low pressure (LP) shaft or spool 214 drivingly connects LP turbine 212 to a gearbox 215 which drives an external load, such as a propeller 216 that is rotatable about longitudinal axis 200.

During operation of turboprop engine 102, an incoming flow of air 218 enters turboprop engine 102 through an annular inlet 220, adjacent HP compressor 204, and into HP compressor 204. Inlet air 218 is routed through HP compressor 204 where the pressure is increased through sequential stages of HP compressor stator vanes 222 and HP compressor rotor blades 224 that are coupled to HP shaft 210 forming compressed air 226. Compressed air 226 is routed into combustion section 206, where at combustion section 206, compressed air 226 is mixed with fuel (not shown) and burned to form hot combustion gases 228. Combustion gases 228 are routed through HP turbine 208 where a portion of the thermal and/or kinetic energy from combustion gases 228 is extracted via sequential stages of HP turbine stator vanes 230 and HP turbine rotor blades 232 that are coupled to HP shaft 210, thus facilitating HP shaft 210 to rotate, thereby supporting operation of HP compressor 204. In the exemplary embodiment, HP shaft 210 includes tierod assembly 300 with two tierods as will be discussed below in reference to FIG. 3. Combustion gases 228 are then routed through LP turbine 212 where a second portion of thermal and kinetic energy is extracted from combustion gases 228 via sequential stages of LP turbine stator vanes 234 and LP turbine rotor blades 236 that are coupled to LP shaft 214, thus facilitating LP shaft 214 to rotate, thereby supporting rotation of propeller 216. Exhaust gases 238 are then exhausted through one or more radial ducts 240.

Figure 3:
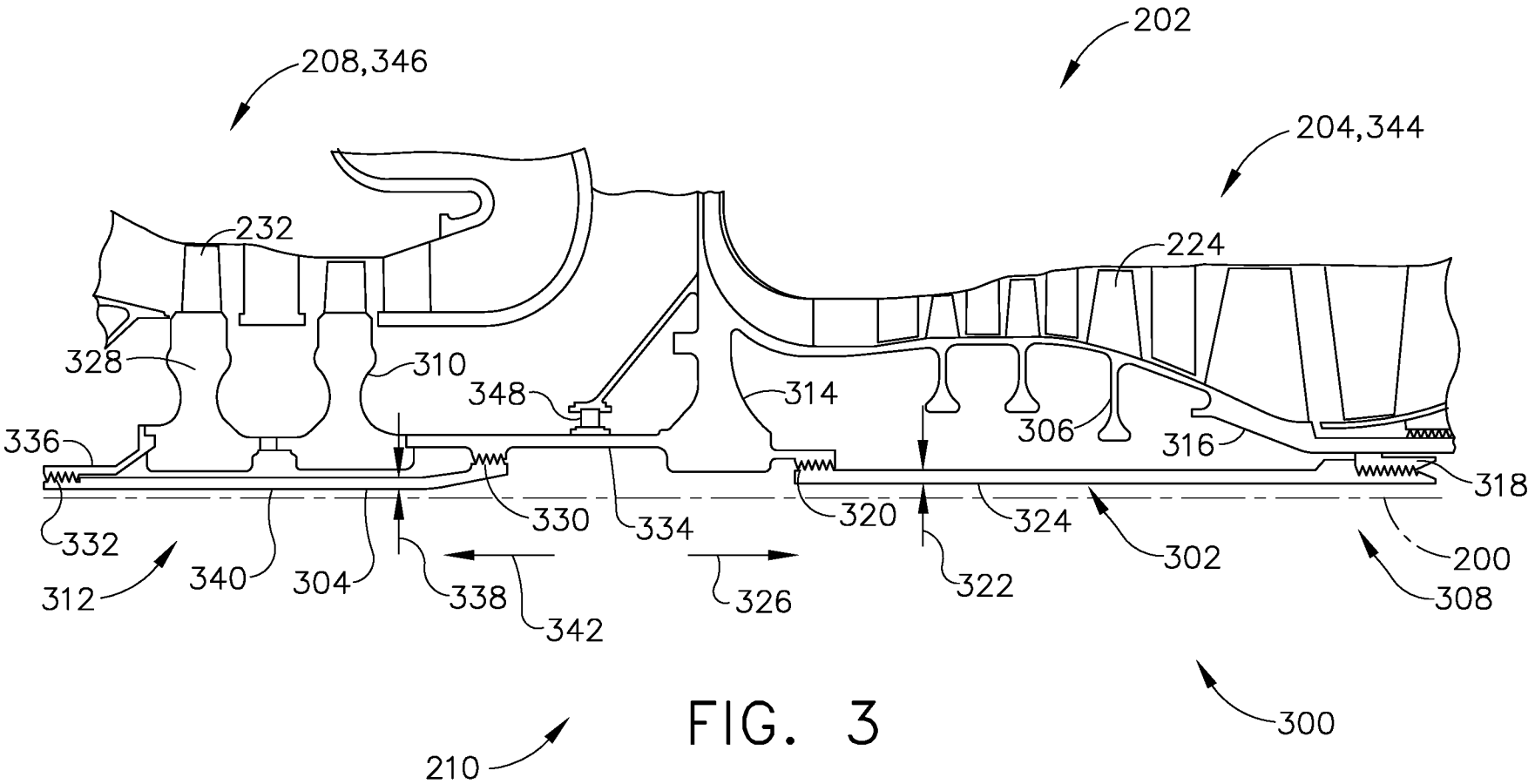
FIG. 3 is a cross-sectional view of an exemplary tierod assembly that may be used with the turboprop engine shown in FIG. 2.

FIG. 3 is a cross-sectional view of an exemplary tierod assembly 300 that may be used with turboprop engine 102 (shown in FIG. 2). In the exemplary embodiment, tierod assembly 300 includes a compressor tierod 302 and a separate turbine tierod 304. HP compressor 204 includes a plurality of rotor blades 224 coupled to at least one rotor disk 306. In the exemplary embodiment, HP compressor 204 is illustrated with four rotor disks 306, however, in alternative embodiments, HP compressor 204 includes any other number of rotor disks 306. Rotor disks 306 are arranged in a face to face orientation and spaced along compressor tierod 302. Rotor disks 306 are coupled together through splined couplings, friction rabbit joints, or any other rotor coupling methods to at least in part form HP compressor rotor assembly 308. Rotor disks 306 are then coupled and clamped together with compressor tierod 302. HP turbine 208 also includes a plurality of rotor blades 232 coupled to at least one rotor disk 310. In the exemplary embodiment, HP turbine 208 is illustrated with two rotor disks 310, however, in alternative embodiments, HP turbine 208 includes any other number of rotor disks 310. Rotor disks 310 are arranged in a face to face orientation and spaced along turbine tierod 304. Rotor disks 310 are coupled together through splined couplings, friction rabbit joints, or any other rotor coupling methods to at least in part form HP turbine rotor assembly 312. Rotor disks 310 are then coupled and clamped together with turbine tierod 304. Additionally, an impeller disk 314 is positioned between HP compressor 204 and HP turbine 208.

In the exemplary embodiment, compressor tierod 302 facilitates coupling HP compressor rotor assembly 308 together. For example, compressor tierod 302 extends between a first stage rotor disk 316 and impeller disk 314. In some embodiments, compressor tierod 302 is coupled to first stage rotor disk 316 through a threaded locknut 318 positioned aft of rotor disk 316 and compressor tierod 302 is coupled to impeller disk 314 through a threaded connection 320. In other embodiments, compressor tierod 302 is coupled to first stage rotor disk 316 through a threaded connection and compressor tierod 302 is coupled to impeller disk 314 through a threaded locknut. In alternative embodiments, compressor tierod 302 clamps HP compressor rotor assembly 308 together through any other connection methods that enables compressor tierod 302 to function as described herein. Furthermore, compressor tierod 302 includes a first diameter 322 and is formed from a first material 324 such that compressor tierod 302 is loaded with a first tension load 326 that facilitates clamping HP compressor rotor assembly 308 together.

Further in the exemplary embodiment, turbine tierod 304 facilitates coupling HP turbine rotor assembly 312 together. For example, turbine tierod 304 extends between impeller disk 314 and a last stage rotor disk 328. In some embodiments, turbine tierod 304 is coupled to impeller disk 314 through a threaded connection 330 and turbine tierod 304 is coupled to last stage rotor disk 328 through a threaded locknut 332 positioned forward of rotor disk 328. In other embodiments, turbine tierod 304 is coupled to impeller disk 314 through an extension arm 334. Extension arm 334 extends forward from impeller disk 314 to facilitate coupling turbine tierod 304 to impeller disk 314. While, in yet further embodiments, turbine tierod 304 is coupled to last stage rotor disk 328 through a disk extension 336. Disk extension 336 extends forward from last stage rotor disk 328 to facilitate coupled turbine tierod 304 to impeller last stage rotor disk 328. In alternative embodiments, turbine tierod 304 clamps HP turbine rotor assembly 312 together through any other connection methods that enables turbine tierod 304 to function as described herein. Furthermore, turbine tierod 304 includes a second diameter 338 and is formed from a second material 340 such that turbine tierod 304 is loaded with a second tension load 342 that facilitates clamping HP turbine rotor assembly 312 together.

During operation of turboprop engine 102, as described above in reference to FIG. 2, HP compressor 204 increases the pressure of inlet air 218 (shown in FIG. 2) before channeling compressed air 226 (shown in FIG. 2) to combustion section 206 (shown in FIG. 2). As such, HP compressor 204 is known as part of a cold engine section 344 that operates at lower temperatures as compared to HP turbine 208 that is aft or upstream of HP compressor 204. HP turbine 208 receives hot combustion gases 228 (shown in FIG. 2) from combustion section 206. As such, HP turbine 208 is known as part of a hot engine section 346 that operates at higher temperatures as compared to HP compressor 204. Because HP shaft 210, including HP compressor rotor assembly 308 and HP turbine rotor assembly 312, is split between cold engine section 344 and hot engine section 346, a temperature gradient therein can be large. By splitting tierod assembly 300 into compressor tierod 302 and turbine tierod 304, each tierod 302 and 304 is formed from material 324 and 340 facilitates matching thermal expansion properties/characteristics of each rotor assembly 308 and 312 respectively. For example, compressor tierod 302 is formed from first material 324 having first diameter 322 and first tension load 326 that corresponds to the thermal expansion properties of HP compressor rotor assembly 308. Turbine tierod 304 is formed from second material 340 having second diameter 338 and second tension load 342 that corresponds to the thermal expansion properties of HP turbine rotor assembly 312.

In the exemplary embodiment, compressor tierod 302 includes first material 324 that is different than second material 340 of turbine tierod 304. For example, compressor tierod 302 is formed from a material that is similar or the same as the material of HP compressor rotor assembly 308. Compressor tierod 302 may also be formed of a material with a thermal expansion coefficient that is similar to the thermal expansion coefficient of HP compressor rotor assembly 308, such as a titanium-alloy material. Similarly, turbine tierod 304 may be formed of a material with a thermal expansion coefficient that is similar to the thermal expansion coefficient of HP turbine rotor assembly 312, such as a nickel-alloy material. Additionally, first material 324 and second material 340 facilitate increasing efficiency of a cooling system (not shown) that is used to cool components of rotor assemblies 308 and 312 respectively because of the thermal similarities of the materials used therein. In alternative embodiments, first material 324 may be substantially the same as second material 340.

Compressor tierod 302 further includes first diameter 322 that may be different than second diameter 338 of turbine tierod 304. By separating tierod assembly 300 into two tierods 302 and 304, loads are contained within each individual tierod 302 and 304 thus reducing tierod diameters 322 and 338 and reducing the weight of tierod assembly 300. In alternative embodiments, first diameter 322 may be substantially equal to second diameter 338. Furthermore, impeller disk 314 bore diameter is reduced also reducing the weight of engine 102.

Compressor tierod 302 also includes first tension load 326 that is different than second tension load 342 of turbine tierod 304. Tierod tension loads 326 and 342 facilitate reducing separation of rotor assemblies 308 and 312, respectively, during blade-out conditions, and thus may be tailored to individual blade-out conditions. In alternative embodiments, first tension load 326 may be substantially equal to second tension load 342.

Additionally, in the exemplary embodiment, tierod assembly 300 facilitates increased modularity of turboprop engine 102. Turbine tierod 304 enables HP turbine rotor assembly 312 to be removed from core engine 202 without disturbing HP compressor rotor assembly 308. Moreover, with use of two tierods 302 and 304, bearing 348, such as the number 4 bearing, that is coupled to impeller disk 314 is not in a tension load path 326 and 342, such that bearing 348 has increased efficiency and positioning. In the exemplary embodiment, tierod assembly 300 includes two tierods 302 and 304. In alternative embodiments, tierod assembly 300 may include only one of compressor tierod 302 and turbine tierod 304. As such, the other rotor assembly, either HP compressor rotor assembly 308 and HP turbine rotor assembly 312, is coupled together with bolted flanges between the rotor stages.

The above-described embodiments of a turboprop engine provide a high pressure rotor assembly system that facilitates separating a high pressure compressor rotor assembly and a high pressure turbine rotor assembly. Specifically, the tierod assembly includes a compressor tierod that couples together the high pressure compressor rotor assembly, and a turbine tierod that couples together the high pressure turbine rotor assembly. By splitting a high pressure tierod into two separate tierods, the compressor tierod and the turbine tierod, increased management of thermal loads within the high pressure rotor assemblies is provided. Additionally, a separate compressor tierod and turbine tierod facilitates a modulated core engine in which the high pressure turbine rotor assembly may be removed for maintenance without disturbing the high pressure compressor rotor assembly. Furthermore, overall engine weight is reduced.

An exemplary technical effect of the methods, systems, and apparatus described herein includes at least one of: (a) managing thermal loads in a high pressure rotor assembly; (b) increasing modulation of a turboprop engine; (c) decreasing engine weight; (d) increasing engine efficiency; and (e) reducing rotor assembly separation after a blade-out event.

Exemplary embodiments of methods, systems, and apparatus for tierod assemblies are not limited to the specific embodiments described herein, but rather, components of the systems and/or steps of the methods may be utilized independently and separately from other components and/or steps described herein. For example, the methods may also be used in combination with other systems requiring split tierods and the associated methods, and are not limited to practice with only the systems and methods as described herein. Rather, the exemplary embodiment can be implemented and utilized in connection with many other applications, equipment, and systems that may benefit from split tierods.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A core engine comprising:

a first tierod;

a compressor rotor assembly comprising a plurality of compressor rotor disks arranged in a face to face orientation and extending between inner ends and outer ends along a radial direction of the core engine, the inner ends separated outwardly by a first variable distance apart from the first tierod along the radial direction of the core engine;

a second tierod; and a turbine rotor assembly comprising a plurality of turbine rotor disks arranged in a face to face orientation and extending between inner ends and outer ends along the radial direction of the core engine, the inner ends separated outwardly by a second distance apart from the second tierod along the radial direction of the core engine, and wherein said compressor rotor assembly is spaced from said turbine rotor assembly along the axial direction;

wherein said first tierod is loaded with a first tension load clamping the plurality of compressor rotor disks together, and wherein said second tierod is loaded with a second tension load clamping the plurality of turbine rotor disks together.

2. The core engine in accordance with claim 1 further comprising an impeller disk coupled to at least one of said first tierod and said second tierod.

3. The core engine in accordance with claim 2, wherein at least one of said first tierod and said second tierod is coupled to said impeller disk through a threaded connection.

4. The core engine in accordance with claim 2, wherein said first tierod is coupled to said compressor rotor assembly through a locknut positioned aft of a first stage compressor rotor disk of said plurality of compressor rotor disks.

5. The core engine in accordance with claim 2, wherein said first tierod is coupled to said impeller disk through a locknut and said first tierod is coupled to said compressor rotor assembly through a threaded connection at a first stage compressor rotor disk of said plurality of compressor rotor disks.

6. The core engine in accordance with claim 2, wherein said second tierod is coupled to said turbine rotor assembly through a locknut positioned forward of a last stage turbine rotor disk of said plurality of turbine rotor disks.

7. The core engine in accordance with claim 2, wherein said first tierod is coupled to the impeller disk on a first side of said impeller disk, and wherein said second tierod is coupled to said impeller disk through an extension arm on a second side of said impeller disk.

8. The core engine in accordance with claim 2, wherein said second tierod is coupled to a last stage turbine rotor disk through a disk extension.

9. The core engine in accordance with claim 1, wherein said first tierod comprises a first material and said second tierod comprises a second material, the first material is different from the second material.

10. The core engine in accordance with claim 1, wherein said first tierod comprises a first diameter and said second tierod comprises a second diameter, the first diameter is different from the second diameter.

11. The core engine in accordance with claim 1, wherein the first tension load is different from the second tension load.

12. A method of assembling a core engine comprising:

coupling a first tierod to a compressor rotor assembly, the compressor rotor assembly includes a plurality of compressor rotor disks arranged in a face to face orientation and extending between inner ends and outer ends along a radial direction of the core engine, the inner ends separated outwardly by a first variable distance apart from the first tierod along the radial direction of the core engine, said first tierod loaded with a first tension load clamping the plurality of compressor rotor disks together;

coupling a second tierod to a turbine rotor assembly, the turbine rotor assembly includes a plurality of turbine rotor disks arranged in a face to face orientation and extending between inner ends and outer ends along the radial direction of the core engine, the inner ends separated outwardly by a second distance apart from the second tierod along the radial direction of the core engine, said second tierod loaded with a second tension load clamping the plurality of turbine rotor disks together; and positioning the compressor rotor assembly at a location spaced along an axial direction of the core engine from the turbine rotor assembly.

13. The method in accordance with claim 12 further comprising coupling at least one of the first tierod and the second tierod to an impeller disk.

14. The method in accordance with claim 12 further comprising coupling at least one of the first tierod and the second tierod to an impeller disk through a threaded connection.

15. The method in accordance with claim 12 further comprising coupling the second tierod to an impeller disk through a disk extension.

16. The method in accordance with claim 12, wherein the first tierod is coupled to the compressor rotor assembly through a locknut positioned aft of a first stage compressor rotor disk of the plurality of compressor rotor disks.

17. The method in accordance with claim 12, wherein the second tierod is coupled to the turbine rotor assembly through a locknut positioned forward of a last stage turbine rotor disk of the plurality of turbine rotor disks.

18. The method in accordance with claim 12, wherein the first tierod comprises a first material and the second tierod comprises a second material, the first material is different from the second material.

19. The method in accordance with claim 12, wherein the first tierod comprises a first diameter and the second tierod comprises a second diameter, the first diameter is different from the second diameter.

20. The method in accordance with claim 12, wherein the first tension load is different from the second tension load.

* * * * *